US007414365B2

(12) United States Patent
Kang

(10) Patent No.: US 7,414,365 B2
(45) Date of Patent: Aug. 19, 2008

(54) PLASMA DISPLAY PANEL

(75) Inventor: Kyoung-Doo Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 357 days.

(21) Appl. No.: 11/253,640

(22) Filed: Oct. 20, 2005

(65) Prior Publication Data

US 2006/0087235 A1 Apr. 27, 2006

(30) Foreign Application Priority Data

Oct. 25, 2004 (KR) ..... 10-2004-0085393

(51) Int. Cl.
*H01J 17/49* (2006.01)

(52) U.S. Cl. ..... 313/582

(58) Field of Classification Search ..... 313/581–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,400,078 | B1 * | 6/2002 | Van Bommel et al. | 313/582 |
| 6,630,916 | B1 | 10/2003 | Shinoda | |
| 6,707,436 | B2 | 3/2004 | Setoguchi et al. | |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology: Annex B—Relationship Between Voltage Terms And Discharge Characteristics; Annex C—Gapa and Annex D—Manufacturing.

* cited by examiner

*Primary Examiner*—Vip Patel
(74) *Attorney, Agent, or Firm*—Robert E. Bushnell, Esq.

(57) ABSTRACT

A plasma display panel in which exhaust performance is improved comprises a lower plate and a upper plate disposed opposite to each other. The lower plate comprises exhaust means for exhausting gas from the plasma display panel. The exhaust means comprises exhaust grooves formed on a front surface of a lower plate (or a back substrate). The exhaust grooves extend in a direction in which address electrodes or sustain electrodes extend.

28 Claims, 5 Drawing Sheets

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filled in the Korean Intellectual Property Office on 25 Oct. 2004 and there duly assigned Serial No. 10-2004-0085393.

BACKGROUND OF THE INVENTION

1. Technical Field

The present invention relates to a plasma display panel, and more particularly, to a plasma display panel in which exhaust performance is improved.

2. Related Art

In recent years, the plasma display panel has been in the spotlight as a replacement for the cathode-ray tube display. The plasma display panel is a device in which discharge gas is filled and sealed between two substrates with a plurality of electrodes, and then a discharge voltage is applied to them, thus generating ultraviolet rays. In the device, fluorescent layers formed in a predetermined pattern are excited by the ultraviolet rays to form a desired image.

The plasma display panel comprises a back substrate and a front substrate disposed opposite to each other. A plurality of address electrodes are arranged on an upper surface of the back substrate, and these address electrodes are buried by first dielectric layers. Partition walls partition discharge cells in a matrix shape on an upper surface of the first dielectric layers. Although partition walls of stripe shape were widely used, a closed type of partition wall, quadrilateral in shape, has been primarily used in recent years in order to reduce the possibility of cross-talk between discharge cells.

An inside surface of the discharge cells partitioned by these partition walls is coated to a predetermined thickness with fluorescent layers.

The front substrate is a transparent substrate into which visible rays can be transmitted, is mainly made of glass, and is combined with the back substrate. Pairs of sustain electrodes which intersect the address electrodes are formed on a bottom surface of the front substrate. In the pairs of sustain electrodes, one sustain electrode is an X electrode, and the other sustain electrode is a Y electrode.

The pairs of sustain electrodes are buried by transparent second dielectric layers, and protective layers are formed on the bottom surface of the second dielectric layers. Since the protective layers emit secondary electrons inside the discharge cells with increased efficiency, they lower the discharge voltage applied between electrodes and protect the electrodes.

In the case of a closed type of partition walls, gas communication between the discharge cells is not smooth. Therefore, it is difficult to exhaust impure gas or to inject discharge gas.

SUMMARY OF THE INVENTION

The present invention provides a plasma display panel in which exhaust performance is improved.

According to an aspect of the present invention, a plasma display panel comprises a lower plate and an upper plate disposed opposite to each other, wherein the lower plate comprises exhaust means for exhausting the plasma display panel.

According to another aspect of the present invention, a plasma display panel comprises: a back substrate; a front substrate disposed apart from the back substrate; partition walls arranged between the front substrate and the back substrate for partitioning discharge cells; pairs of sustain electrodes disposed opposite to each other to allow discharge to occur inside the discharge cells; address electrodes intersecting the pairs of sustain electrodes; fluorescent layers arranged inside the discharge cells; and discharge gas disposed inside the discharge cells. Exhaust grooves extending across the discharge cells extending in one direction are formed on the front surface of the back substrate.

According to another aspect of the present invention, a plasma display panel comprises: a back substrate; a front substrate disposed apart from the back substrate; partition walls arranged between the front substrate and the back substrate for partitioning discharge cells; pairs of sustain electrodes disposed opposite to each other to allow discharge to occur inside the discharge cells; address electrodes intersecting the pairs of sustain electrodes; fluorescent layers arranged inside the discharge cells; discharge gas disposed inside the discharge cells; and separation members arranged between the back substrate and the partition walls for separating the back substrate and the partition walls.

According to the present invention, because an exhaust passage is secured by grooves formed in the back substrate or the separation members, exhaust of impurity gas and injection of discharge gas is smooth. Furthermore, because the lower plate can be formed with only the back substrate, the problem of aligning the upper plate and the lower plate is substantially solved. Furthermore, because the pairs of sustain electrodes perform opposing discharges, discharge space is widened and the discharge is made even, and thus brightness and light emitting efficiency are improved. Because sustain electrodes having an opaque bus electrode are not arranged on the front substrate, penetration of visible rays into the front substrate is improved, and thus brightness is improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully with reference to the accompanying drawings, in which exemplary embodiments of the present invention are shown.

Figure 1:
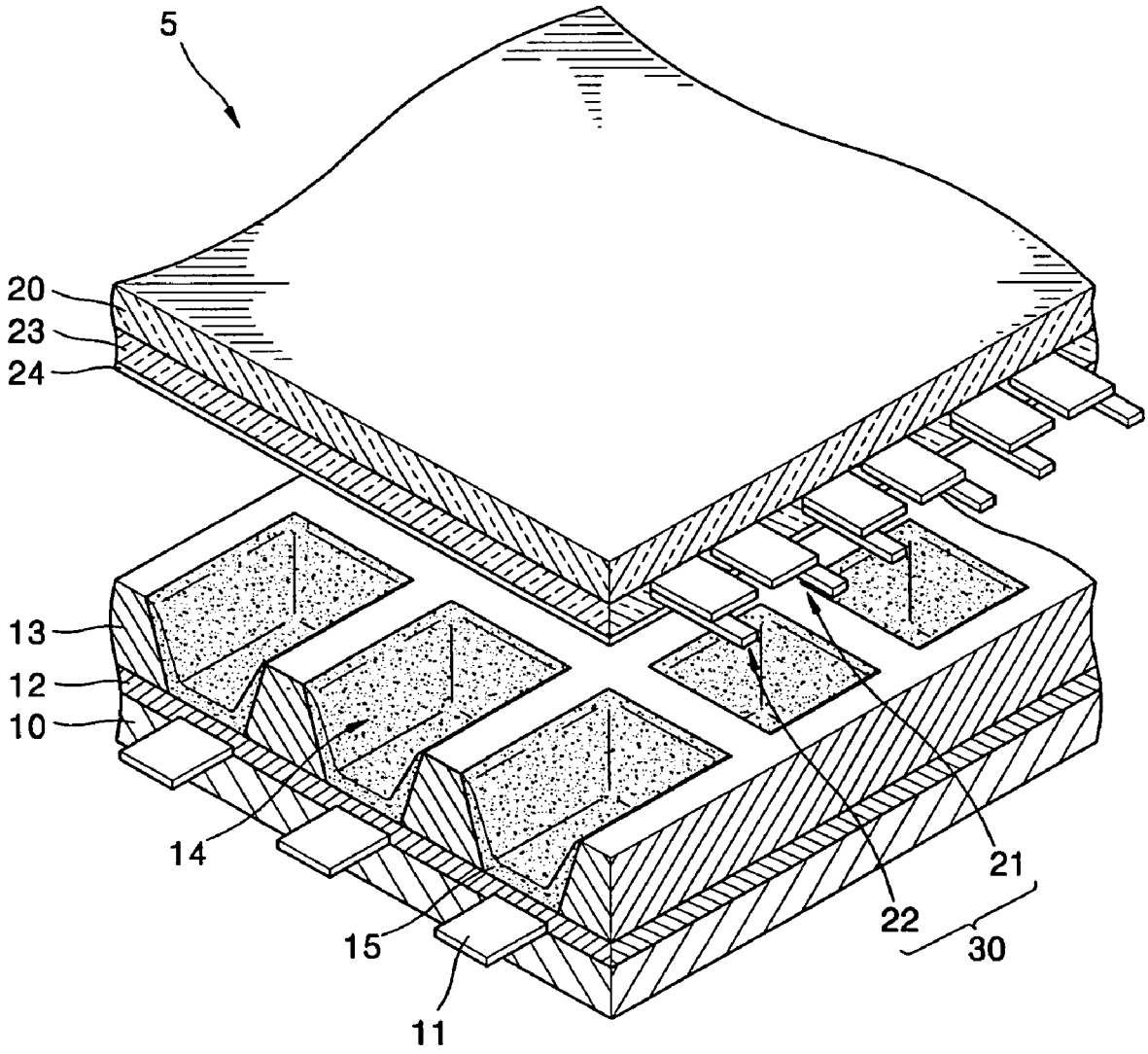
FIG. 1 is an exploded perspective view illustrating a plasma display panel.

FIG. 1 an exploded perspective view illustrating a plasma display panel, and more specifically an AC type three-electrode surface-discharge plasma display panel. "Front" in the specification indicates the direction in which images are displayed.

Referring to FIG. 1, a plasma display panel 5 comprises a back substrate 10 and a front substrate 20 disposed opposite to each other. A plurality of address electrodes 11 are arranged on an upper surface of the back substrate 10, and these address electrodes 11 are buried by first dielectric layers 12. Partition walls 13 partition discharge cells 14 in a matrix shape on an upper surface of the first dielectric layers 12. Partition walls of stripe shape were previously in wide use. However, recently, a closed type of partition wall, quadrilateral in shape, has been primarily used in order to reduce the possibility of cross-talk between discharge cells.

An inside surface of the discharge cells 14, partitioned by partition walls 13, is coated to a predetermined thickness with fluorescent layers 15.

The front substrate 20 is a transparent substrate into which visible rays can be transmitted, is mainly made of glass, and is combined with the back substrate 10. Pairs of sustain electrodes 30 which intersect the address electrodes 11 are formed on a bottom surface of the front substrate 20. The pairs of sustain electrodes 30 include an X electrode 21 and a Y electrode 22.

The pairs of sustain electrodes 30 are buried by transparent second dielectric layers 23, and protective layers 24 are formed on the bottom surface of the second dielectric layers 23. Since the protective layers 24 emit secondary electrons inside the discharge cells with increased efficiency, they lower the discharge voltage applied between electrodes and protect the electrodes.

In case of a closed type of partition walls, gas communication between the discharge cells is not smooth. Therefore, it is difficult to exhaust impure gas or to inject discharge gas.

The First Embodiment

Figure 2:
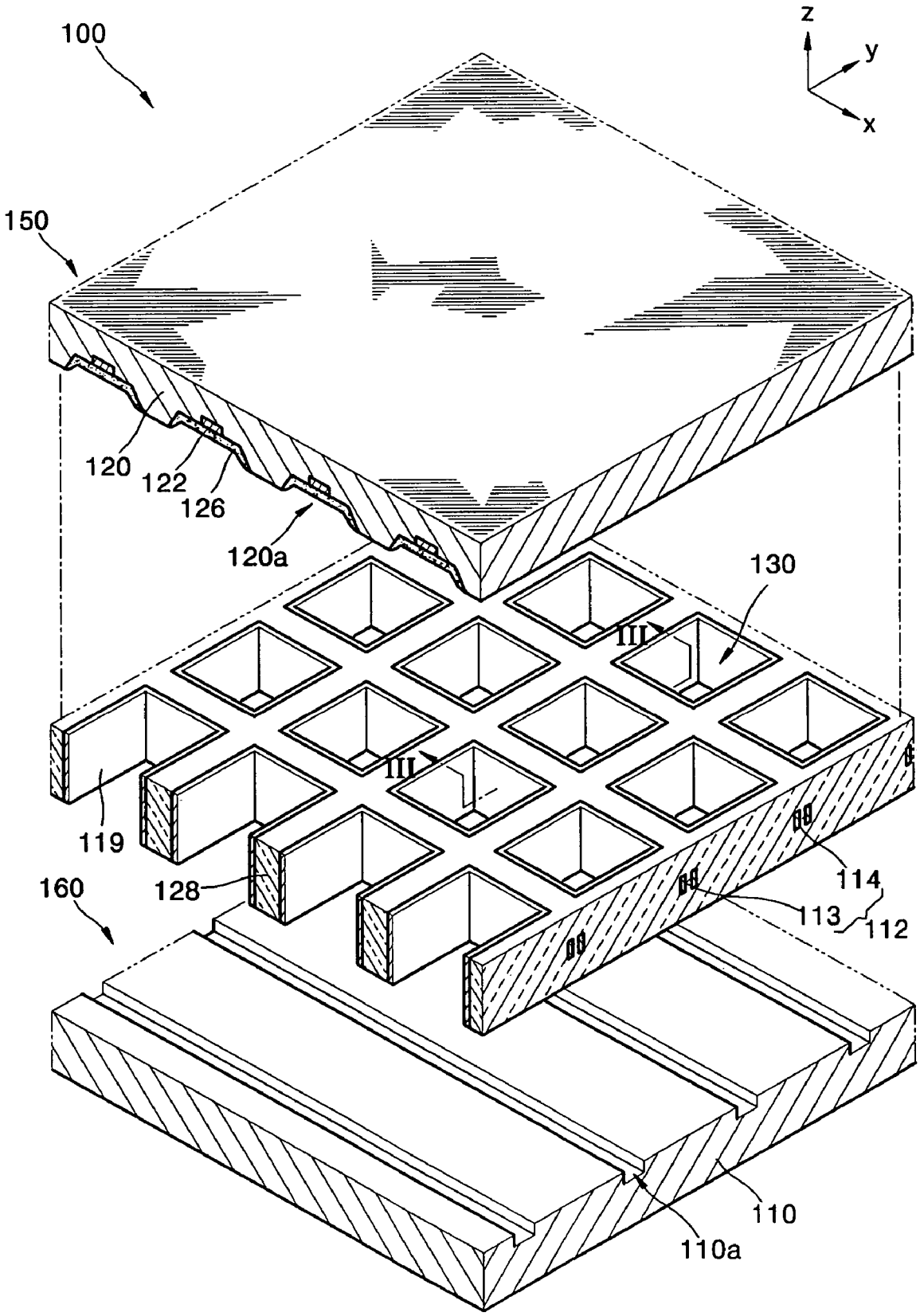
FIG. 2 is an exploded perspective view illustrating a plasma display panel according to a first embodiment of the present invention.
Figure 3:
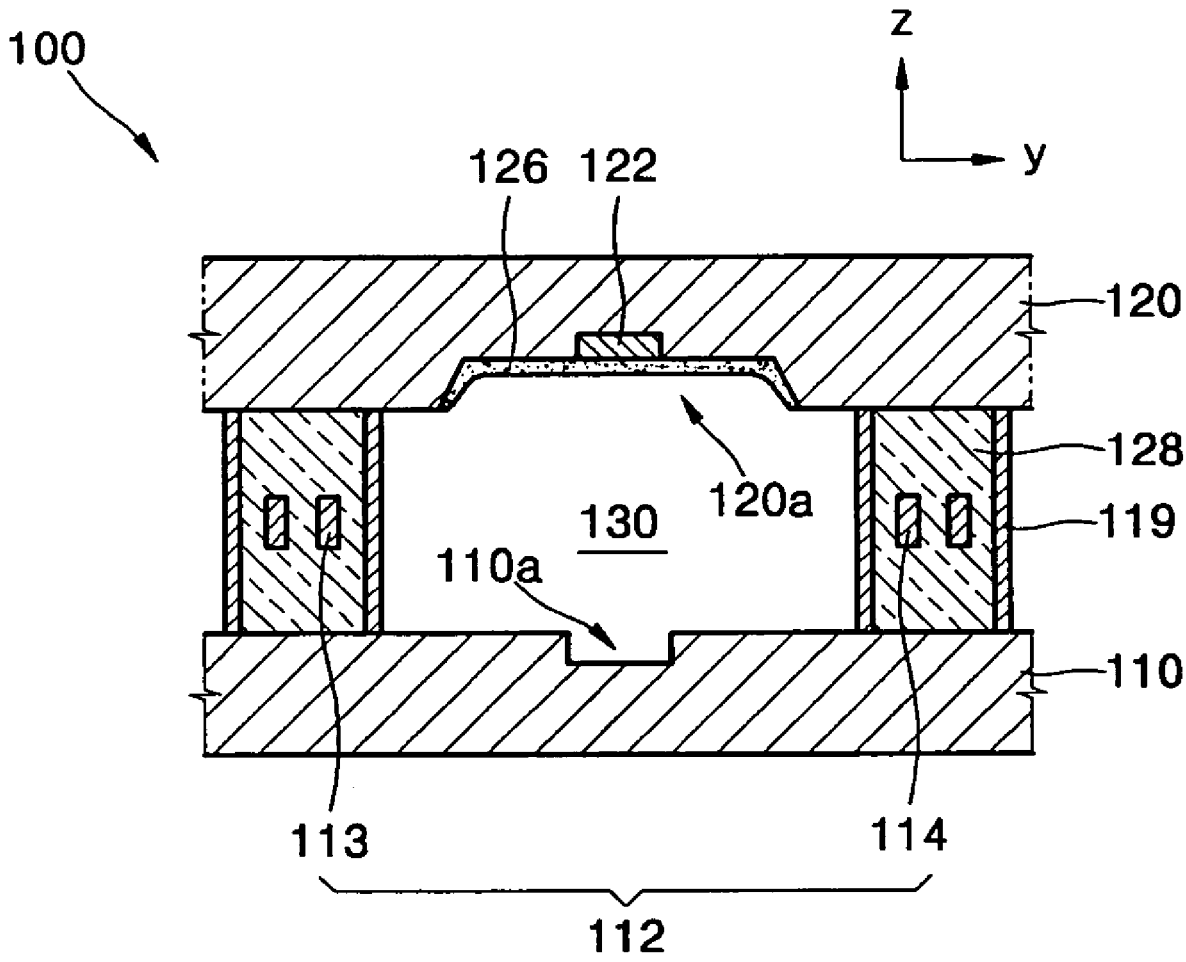
FIG. 3 is a cross-sectional view taken along III-III line of FIG. 2.

FIG. 2 is an exploded cut away perspective view illustrating a plasma display panel according to a first embodiment of the present invention, and FIG. 3 is a cross-sectional view taken along III-III line of FIG. 2. In FIG. 3, the front substrate is rotated at an angle of 90° so as to easily show an internal structure of the plasma display panel 100.

Referring to FIGS. 2 and 3, a plasma display panel 100 according to the first embodiment of the present invention comprises an upper plate 150 and a lower plate 160. The upper plate 150 comprises a front substrate 120, address electrodes 122, fluorescent layers 126, partition walls 128, pairs of sustain electrodes 112, and protective layers 119. The lower plate 160 comprises a back substrate 110.

The back substrate 110 and the front substrate 120 define a plurality of discharge cells 130 which are spaced at a predetermined distance, and which are partitioned by the partition walls 128 between them. The transparent front substrate 120 is made of material having good light permeability, such as glass, and the back substrate 110 is made of glass.

Referring to FIG. 2, the partition walls 128 have a matrix shape in which transverse cross-sections of the discharge cells 130 are quadrilateral, but the shape is not limited to the matrix shape. As long as the partition walls 128 can form a plurality of discharge cells 130, partition walls of various shapes (for example, waffle, delta, etc.) can be formed. Furthermore, the transverse cross-section of the discharge cells 130 can be formed in a polygon shape such as triangle, pentagon, etc., or in a circular shape or oval shape in addition to quadrilateral shape chosen in the present embodiment.

The front substrate 120 and the partition walls 128 can be made in one body. In this regard, the term "one body" does not mean that the front substrate 120 and the partition walls 128 are formed in the same process, but it means that it is difficult to separate the front substrate 120 and the partition walls 128 without any damage thereto.

The pairs of sustain electrodes 112 are disposed opposite to each other inside opposite partition walls 128 between the discharge cells 130. The pairs of sustain electrodes 112 include X electrodes 113 and Y electrodes 114, respectively. Specifically, the X electrodes 113 are arranged inside first partition wall, and the Y electrodes 114 paired with the X electrodes 113 are arranged inside second partition walls opposite to the first partition walls. The sustain electrodes 112 are arranged so as to be parallel to each other at a predetermined distance. These sustain electrodes 112 extend in one direction (x direction), and are formed in a stripe shape.

The partition walls 128 prevent adjacent sustain electrodes 113, 114 from being directly connected electrically to each other, and prevent positive ions or electrons from colliding directly with the sustain electrodes 131, 132 and causing damage to them, while storing wall electric charges by inducing charged particles.

The address electrodes 122 extend in a direction (y direction) so as to intersect the pairs of sustain electrodes 112, and are arranged inside the front substrate 120. The address electrodes 122 extend across the discharge cells 130, and have a stripe shape. The address electrodes 122 cause address discharge to occur so as to facilitate sustain discharge between the X electrodes 113 and the Y electrodes 114. More specifically, the address electrodes 122 function to lower a voltage so as to cause the sustain discharge to occur. The address discharge occurs between the Y electrodes 114 and the address electrode 122.

First grooves 120*a* are formed in a direction (y direction) in which the address electrodes 122 extend, and on a back surface of the front substrate 120 opposite to the discharge cells 130. It is preferable that the first grooves 120*a* extend across the discharge cells 130, and are opposite to central portions of the discharge cells 130. The first grooves 120*a* are formed so as to have a predetermined depth, and preferably a depth in which the address electrodes 122 are buried. That is, it is possible to increase forward penetration of visible rays (in the z direction) by reducing the thickness of the front substrate 120.

The fluorescent layers 126 emitting each of red color, green color, and blue color light are coated to a predetermined thickness inside the first grooves 120*a*. However, the position in which the fluorescent layers 126 are arranged is not limited, but the fluorescent layers 126 may be arranged anywhere inside the discharge cells 130. In order to have a penetration type structure, it is preferable that the fluorescent layers 130 be arranged between the front substrate 120 and the pairs of sustain electrodes 112.

The fluorescent layers 216 include a component which receives ultraviolet rays and emits visible rays. The red color fluorescent layers formed in sub-pixels emitting red light include a fluorescent substance such as Y(V, P)O4:Eu, the green color fluorescent layers formed in sub-pixels emitting green light include a fluorescent substance such as Zn2SiO4:Mn, and the blue color fluorescent layers formed in sub-pixels emitting blue light include a fluorescent substance such as BAM:Eu.

It is preferable that protective layers 119 be formed on side surfaces of the partition walls 128. The protective layers 119 prevent the pairs of sustain electrodes 112 and partition walls 128 made of dielectric substance from being damaged due to sputtering of plasma particles, and they lower discharge voltage by emitting secondary electrons. The protective layers 119 can be formed by coating, to a predetermined thickness, side surfaces of the partition walls 128 with MgO. The MgO layers 119 are mainly formed as a thin film by sputtering or an E-beam evaporation method.

Discharge gas, such as Ne, Xe, etc., and a mixture thereof are injected inside the discharge cells 130.

Second grooves 110*a* are formed in a direction (the x direction) parallel to a direction in which the pairs of sustain electrodes 112 extend, and on the front surface of the back substrate 110. It is preferable that the second grooves 110*a* extend across the discharge cells 130, and be opposite to central portions of the discharge cells 130. However, the direction in which the second grooves 110*a* extend is not limited to the above-mentioned direction. The second grooves 110*a* may extend in a direction in which the address electrodes 122 extend, or in an oblique direction, and so on.

Such second grooves 130 function as an exhaust passage. For example, as in the present embodiment, when partition walls 128 have a closed type of structure, it is difficult to exhaust impure gas remaining inside the discharge cells 130 and to inject discharge gas. However, in the present invention, because the second grooves 110*a* which perform the function of an exhaust passage are formed, it is possible to perform the exhaust and injection processes more smoothly.

In the plasma display panel 100 according to the present invention, after separately manufacturing the upper plate 150 and the lower plate 160, the upper plate 150 and the lower plate 160 are aligned, coupled, and sealed by a seal element, such as frit glass. In contrast, in a three-electrode surface-discharge structure, alignment of the upper plate with the lower plate is very difficult because pixels of the plasma display panel are very small. However, in the plasma display panel 100 according to the present embodiment, because the lower plate 160 has only the back substrate 110, when assembling the upper plate 150 with the lower plate 160, there is no problem of aligning the upper plate 150 and the lower plate 160. Therefore, the process of assembling the upper plate 150 and the lower plate 160 is very convenient.

In the plasma display panel 100 according to the present invention having the above-mentioned structure, visible rays emitted from the fluorescent layers 129 penetrate the front substrate 120 and are irradiated outside. Therefore, the plurality of address electrodes 122 arranged on a bottom surface of the front substrate 120 are made of a transparent conductive material, such as ITO (Indium Tin Oxide), so as to allow visible rays to penetrate. However, the pairs of sustain electrodes 112 arranged inside the partition walls 128 do not require transparency, and thus they can be made of general conductive metal material. Since the pairs of sustain electrodes 112 may be made of metal materials having excellent conductive property and low resistance property (such as Ag, Al, Cu, etc.), it is possible to quicken the response speed depending on discharge, to produce undistorted signals, and to reduce power required for sustain discharge.

The function of the plasma display panel 100 according to the first embodiment of the present invention having the above-mentioned structure is as follows.

As an address voltage is applied between the address electrodes 122 and the Y electrodes 114, address discharge occurs. As a result of the address discharge, the discharge cells 130 in which the sustain discharge is to occur are selected. Thereafter, when a discharge sustain voltage is applied between the X electrodes 113 and the Y electrodes 114 of the selected discharge cells 130, the sustain discharge occurs by movement of wall charge stored at the X electrodes 113 and the Y electrodes 114, and ultraviolet rays are emitted while energy level of discharge gas excited during sustain discharging is lowered. Then, these ultraviolet rays excite fluorescent layers 129 coated inside discharge cells 130, and visible rays are emitted while the energy level of the excited fluorescent layers 129 is lowered. These visible rays form an image which a user can recognize, while penetrating and irradiating the front substrate 120. Specifically, in the present invention, because the X electrodes 113 and the Y electrodes 114 are disposed opposite to each other, opposite discharge occurs during sustain discharge. Therefore, the degree of utilization of the discharge space increases compared to a surface-discharge structure. As a result, the amount of plasma increases, and brightness and light emitting efficiency are improved. Furthermore, because discharge occurs evenly in the discharge cells, the discharge is stable.

The Second Embodiment

Figure 4:
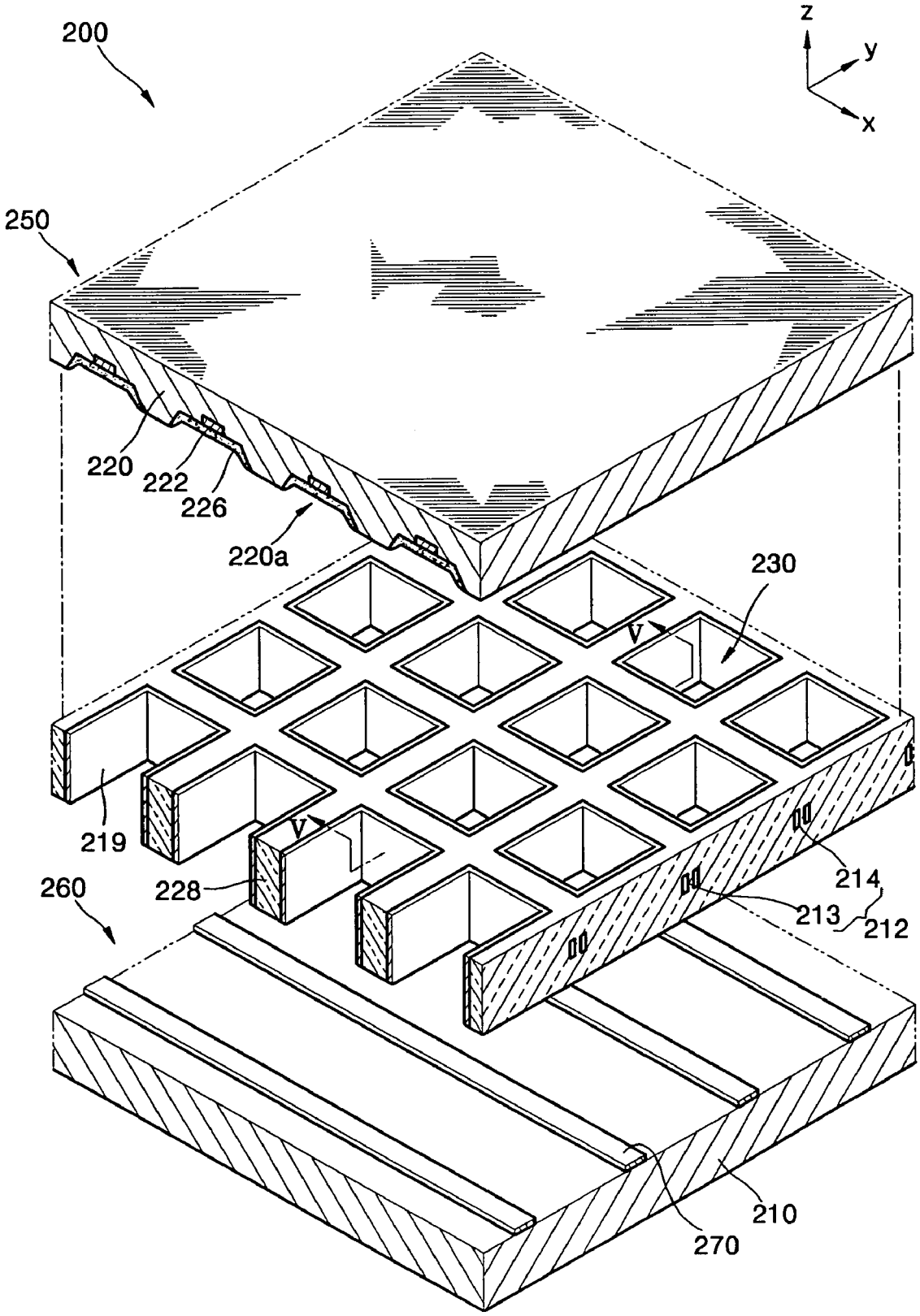
FIG. 4 is an exploded perspective view illustrating a plasma display panel according to a second embodiment of the present invention.
Figure 5:
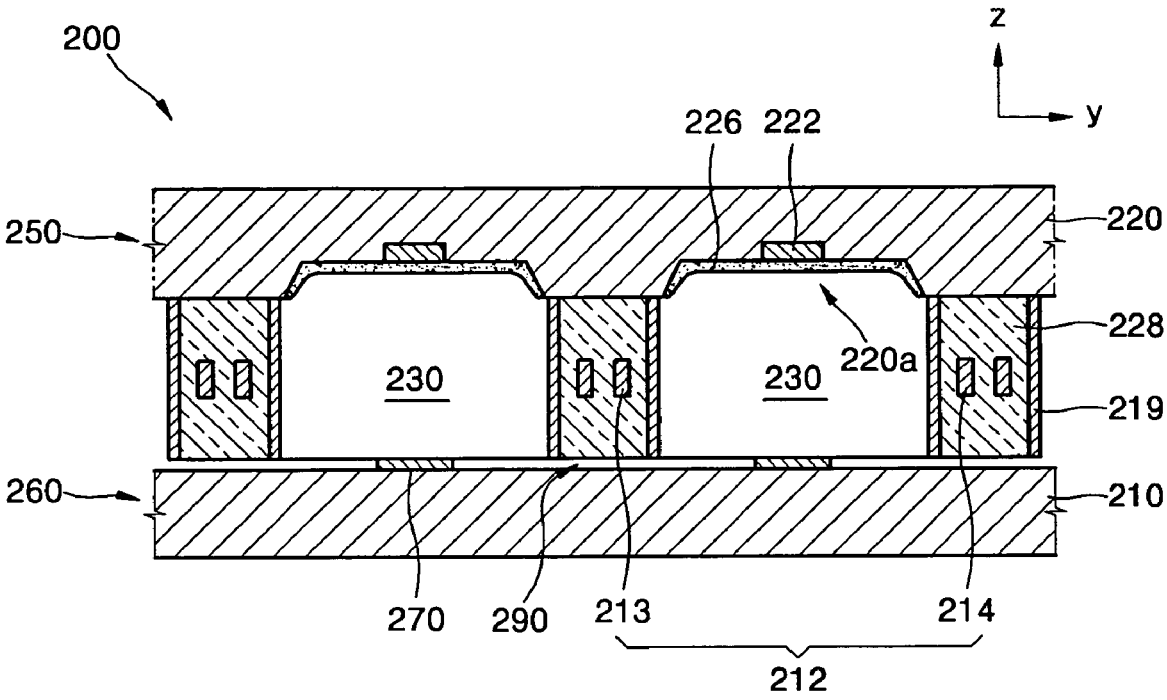
FIG. 5 is a cross-sectional view taken along V-V line of FIG. 4.

FIG. 4 is an exploded perspective view illustrating a plasma display panel according to a second embodiment of the present invention, and FIG. 5 is a cross-sectional view taken along V-V line of FIG. 4. In FIG. 5, in order to easily show an internal structure of a plasma display panel 200, the front substrate is rotated at an angle of 90°.

The plasma display panel 200 comprises an upper plate 250 and a lower plate 260. That part of the structure which is different from that of the first embodiment will be mainly described.

In the first embodiment, the second grooves 110*a* are formed in the back substrate 110. However, in the plasma display panel 200 according to the second embodiment, lower plate 260 includes separation members 270 between the back substrate 210 and partition walls 228. Stripe grids, as separation members 270, are shown in the second embodiment. The stripe grids 270 have a predetermined height and a shape which extends in one direction, and the length of the stripe grids can vary. Furthermore, the shape of separation members 270 is not limited to the stripe grid. A shape having a predetermined height so as to form a space between the back substrate 210 and the partition walls 228 is sufficient.

These stripe grids 270 are arranged so as to be parallel and at a predetermined distance therebetween. In the second embodiment, the stripe grids 270 extend along a direction (x direction) in which the pairs of sustain electrodes 212 extend, but the direction in which stripe grids 270 are arranged is not limited thereto. The direction can vary. For example, the direction (y direction) in which the address electrode 222 extend or an oblique direction is also possible.

The stripe grids 270 can be formed through various methods, and preferably are formed by using an electrode forming method, such as a photolithography method.

An exhaust passage 290 is formed between the back substrate 210 and the partition walls 228 by the stripe grids 270 arranged in this manner. Therefore, the exhaust and injection processes can be performed more smoothly through the exhaust passage 290.

The structures and functions of the pairs of sustain electrodes 212 (including the X electrodes 213 and the Y electrodes 214), the protective layers 219, the discharge cells 230, the partition walls 228, the fluorescent layers 226, the address electrode 222, and the front substrate 220 on which grooves 220*a* are formed are similar to those of the first embodiment.

The operational process of the plasma display panel 200 according to the second embodiment having the above-mentioned structure is the same as that of the first embodiment, and thus a detailed explanation is omitted.

When employing the present invention, it is possible to manufacture a plasma display panel in which exhaust performance is improved.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a back substrate;

a front substrate disposed apart from the back substrate;

partition walls arranged between the front substrate and the back substrate for partitioning discharge cells;

pairs of sustain electrodes disposed opposite to each other for allowing discharge to occur inside the discharge cells;

address electrodes intersecting the pairs of sustain electrodes;

fluorescent layers disposed inside the discharge cells;

discharge gas disposed inside the discharge cells; and exhaust grooves formed on a front surface of the back substrate extending across the discharge cells extending in one direction;

wherein the exhaust grooves are formed opposite central portions of the discharge cells.

2. The plasma display panel according to claim 1, wherein the exhaust grooves formed on the front surface of the back substrate extend in a direction in which the address electrodes extend.

3. The plasma display panel according to claim 1, wherein the exhaust grooves formed on the front surface of the back substrate extend in a direction in which the pairs of sustain electrodes extend.

4. The plasma display panel according to claim 1, wherein the pairs of sustain electrodes are disposed inside the partition walls.

5. The plasma display panel according to claim 1, wherein the partition walls are disposed so as to have a matrix shape.

6. The plasma display panel according to claim 5, wherein the partition walls are formed so that the discharge cells have a transverse cross-section of a quadrilateral shape.

7. The plasma display panel according to claim 1, wherein the fluorescent layers are disposed between the front substrate and the pairs of sustain electrodes.

8. The plasma display panel according to claim 1, further comprising grooves formed on a back surface of the front substrate opposite to the discharge cells, the fluorescent layers being disposed inside the grooves.

9. The plasma display panel according to claim 1, wherein the address electrodes are disposed inside the front substrate.

10. The plasma display panel according to claim 1, wherein the partition walls are made of a dielectric substance.

11. The plasma display panel according to claim 1, wherein the partition walls and the front substrate are made in one body.

12. A plasma display panel, comprising:

a back substrate;

a front substrate disposed apart from the back substrate;

partition walls arranged between the front substrate and the back substrate for partitioning discharge cells;

pairs of sustain electrodes disposed opposite to each other for allowing discharge to occur inside the discharge cells;

address electrodes intersecting the pairs of sustain electrodes;

fluorescent layers disposed inside the discharge cells;

discharge gas disposed inside the discharge cells; and separation members disposed between the back substrate and the partition walls for separating the back substrate and the partition walls.

13. The plasma display panel according to claim 12, wherein the separation members are disposed across the discharge cells.

14. The plasma display panel according to claim 13, wherein the separation members are disposed in a direction in which the pairs of sustain electrodes extend.

15. The plasma display panel according to claim 13, wherein the separation members are disposed in a direction in which the address electrodes extend.

16. The plasma display panel according to claim 12, wherein the separation members have a stripe shape.

17. The plasma display panel according to claim 12, wherein the pairs of sustain electrodes are disposed inside the partition walls.

18. The plasma display panel according to claim 12, wherein the partition walls are disposed so as to have a matrix shape.

19. The plasma display panel according to claim 18, wherein the partition walls are formed so that the discharge cells have a transverse cross-section of a quadrilateral shape.

20. The plasma display panel according to claim 12, wherein the fluorescent layers are disposed between the front substrate and the pairs of sustain electrodes.

21. The plasma display panel according to claim 12, further comprising grooves formed on a back surface of the front substrate opposite to the discharge cells, the fluorescent layers being disposed inside the grooves.

22. The plasma display panel according to claim 12, wherein the address electrodes are disposed inside the front substrate.

23. The plasma display panel according to claim 12, wherein the partition walls are made of a dielectric substance.

24. The plasma display panel according to claim 12, wherein the partition walls and the front substrate are made in one body.

25. A plasma display panel comprising a lower plate and an upper plate disposed opposite to each other;

wherein the lower plate comprises exhaust means for exhausting gas from the plasma display panel;

wherein the lower plate comprises a back substrate, and said exhaust means comprises exhaust grooves formed on said back substrate; and wherein the exhaust grooves extend parallel to the upper plate and the lower plate, and extend in one of a direction in which the address electrodes extend and a direction in which the sustain electrodes extend.

26. The plasma display panel according to claim 25, further comprising address electrodes, and wherein the exhaust grooves extend in a direction in which the address electrodes extend.

27. The plasma display panel according to claim 25, further comprising sustain electrodes, and wherein the exhaust grooves extend in a direction in which the sustain electrodes extend.

28. A plasma display panel comprising a lower plate and an upper plate disposed opposite to each other;

wherein the lower plate comprises exhaust means for exhausting gas from the plasma display panel;

wherein the upper plate comprises partition walls for partitioning the discharge cells; and wherein the lower plate comprises a back substrate and separation members for separating the back substrate and the partition walls.

* * * * *